US009903202B2

(12) United States Patent
Willison

(10) Patent No.: US 9,903,202 B2
(45) Date of Patent: Feb. 27, 2018

(54) SHIELD FOR SUMPING FRAME OF MINING MACHINE

(71) Applicant: Joy MM Delaware, Inc., Wilmington, DE (US)

(72) Inventor: John Willison, Cranberry, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 14/868,024

(22) Filed: Sep. 28, 2015

(65) Prior Publication Data

US 2017/0089197 A1 Mar. 30, 2017

(51) Int. Cl.

| | |
|---|---|
| ***E21C 27/24*** | (2006.01) |
| ***E21C 35/20*** | (2006.01) |
| ***E21C 35/04*** | (2006.01) |
| ***E21C 25/06*** | (2006.01) |
| ***E21F 13/00*** | (2006.01) |

(Continued)

(52) U.S. Cl.

CPC ..... *E21C 35/04* (2013.01); *E21C 25/06* (2013.01); *E21C 27/24* (2013.01); *E21C 35/12* (2013.01); *E21C 35/20* (2013.01); *E21C 35/22* (2013.01); *E21F 13/00* (2013.01)

(58) Field of Classification Search

CPC ..... E21C 27/24; E21C 35/20; E21C 35/06; E21D 9/1013; E21D 9/102; E21D 9/1026; E21D 9/1033

See application file for complete search history.

(56) References Cited

U.S. PATENT DOCUMENTS

| | | | | |
|---|---|---|---|---|
| 6,224,164 | B1 * | 5/2001 | Hall | E21C 27/24 299/33 |
| 2004/0245844 | A1 | 12/2004 | Lowery | |
| 2005/0156460 | A1 | 7/2005 | Brandl | |

(Continued)

FOREIGN PATENT DOCUMENTS

| | | | |
|---|---|---|---|
| AU | 2013237720 | A1 | 10/2013 |
| WO | 2015000710 | A2 | 1/2015 |
| WO | 2015000711 | A2 | 1/2015 |

OTHER PUBLICATIONS

Extended European Search Report from the European Patent Office for Application No. 16002095.4 dated Jan. 24, 2017 (7 pages).

*Primary Examiner* — David J Bagnell
*Assistant Examiner* — Michael A Goodwin
(74) *Attorney, Agent, or Firm* — Michael Best & Friedrich LLP

(57) ABSTRACT

A mining machine includes a chassis, a boom, a cutting head, and a shield supported for movement relative to the chassis. The chassis includes a first end and a second end, and defines a longitudinal axis extending between the first end and the second end. The boom includes a first end and a second end, and the boom is supported for movement relative to the chassis. The boom translates in a first direction and is pivotable relative to the chassis between first and second positions. The cutting head is coupled to the second end of the boom and is supported for rotation relative to the boom. The cutting head is rotatable about a cutting head axis. The shield is supported for movement relative to the chassis and positioned proximate the cutting head. In some embodiments, the shield is coupled to a sumping frame supported for movement relative to the chassis.

22 Claims, 5 Drawing Sheets

(51) Int. Cl.
*E21C 35/12* (2006.01)
*E21C 35/22* (2006.01)

(56) References Cited

U.S. PATENT DOCUMENTS

| | | | | |
|---|---|---|---|---|
| 2005/0218711 | A1 | 10/2005 | Watson | |
| 2008/0217986 | A1* | 9/2008 | LeBegue | E21C 25/10 299/58 |
| 2009/0066148 | A1 | 3/2009 | Willison | |
| 2011/0221259 | A1 | 9/2011 | Schaffer | |
| 2011/0248548 | A1 | 10/2011 | Junker et al. | |
| 2012/0267940 | A1 | 10/2012 | O'Neill et al. | |
| 2014/0070599 | A1 | 3/2014 | Steinberg et al. | |
| 2016/0146006 | A1* | 5/2016 | Brandl | E21C 27/24 299/67 |

* cited by examiner

SHIELD FOR SUMPING FRAME OF MINING MACHINE

BACKGROUND

The present application relates to mining machines, and in particular to continuous mining and entry development machines.

Conventional underground mining machines include a cutting head supported for rotation on an arm or a boom. A continuous mining operation often includes alternating sump and shear cutting cycles wherein the cutting head is first actuated through a sump or horizontal cut into a mine face, and then the cutting head is moves in a shear or vertical direction across the mine face to cut mineral from the face. The mining apparatus is then moved forward using a drive system (e.g., tracks or the like) and is again positioned adjacent the face for another sump and shear cutting sequence. The mining machine may also include a gathering head to direct or load the cut material into a conveyor system or a haulage vehicle such as a shuttle car.

SUMMARY

In one aspect, a mining machine includes a chassis, a boom, a cutting head, and a shield. The chassis includes a first end and a second end, and defines a longitudinal axis extending between the first end and the second end. The boom includes a first end and a second end, and the boom is supported for movement relative to the chassis. The boom translates in a first direction and is pivotable relative to the chassis between a first position and a second position. The cutting head is coupled to the second end of the boom and is supported for rotation relative to the boom. The cutting head is rotatable about a cutting head axis. The shield is supported for movement relative to the chassis and positioned proximate the cutting head.

In another aspect, a sumping assembly for a mining machine having a chassis defining a longitudinal axis includes a boom, a cutting head, and a shield. The boom includes a first end and a second end, and the boom is configured to be supported for movement relative to the chassis. The boom translates in a first direction and a second direction opposite the first direction. The cutting head is coupled to the second end of the boom and is supported for rotation relative to the boom. The cutting head rotates about a cutting head axis. The shield is coupled to the boom and positioned proximate the cutting head. The shield is oriented substantially perpendicular to the first direction.

In yet another aspect, a mining machine includes a chassis, a sumping frame, a boom, a conveyor, a cutting head, and a shield. The chassis includes a first end and a second end and defines a chassis axis extending between the first end and the second end. The sumping frame is supported for movement relative to the chassis. The boom includes a first end and a second end, and the first end is pivotably coupled to the sumping frame. The conveyor is coupled to the sumping frame and includes flights for moving cut material toward the second end of the chassis. The conveyor is coupled to the sumping frame. The cutting head is coupled to the second end of the boom and is supported for rotation relative to the boom. The cutting head is rotatable about a cutting head axis. The shield is coupled to the sumping frame and positioned proximate the cutting head. The shield is oriented substantially perpendicular to the chassis axis.

Other features and aspects will become apparent by consideration of the detailed description and accompanying drawings.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

DETAILED DESCRIPTION

Figure 1:
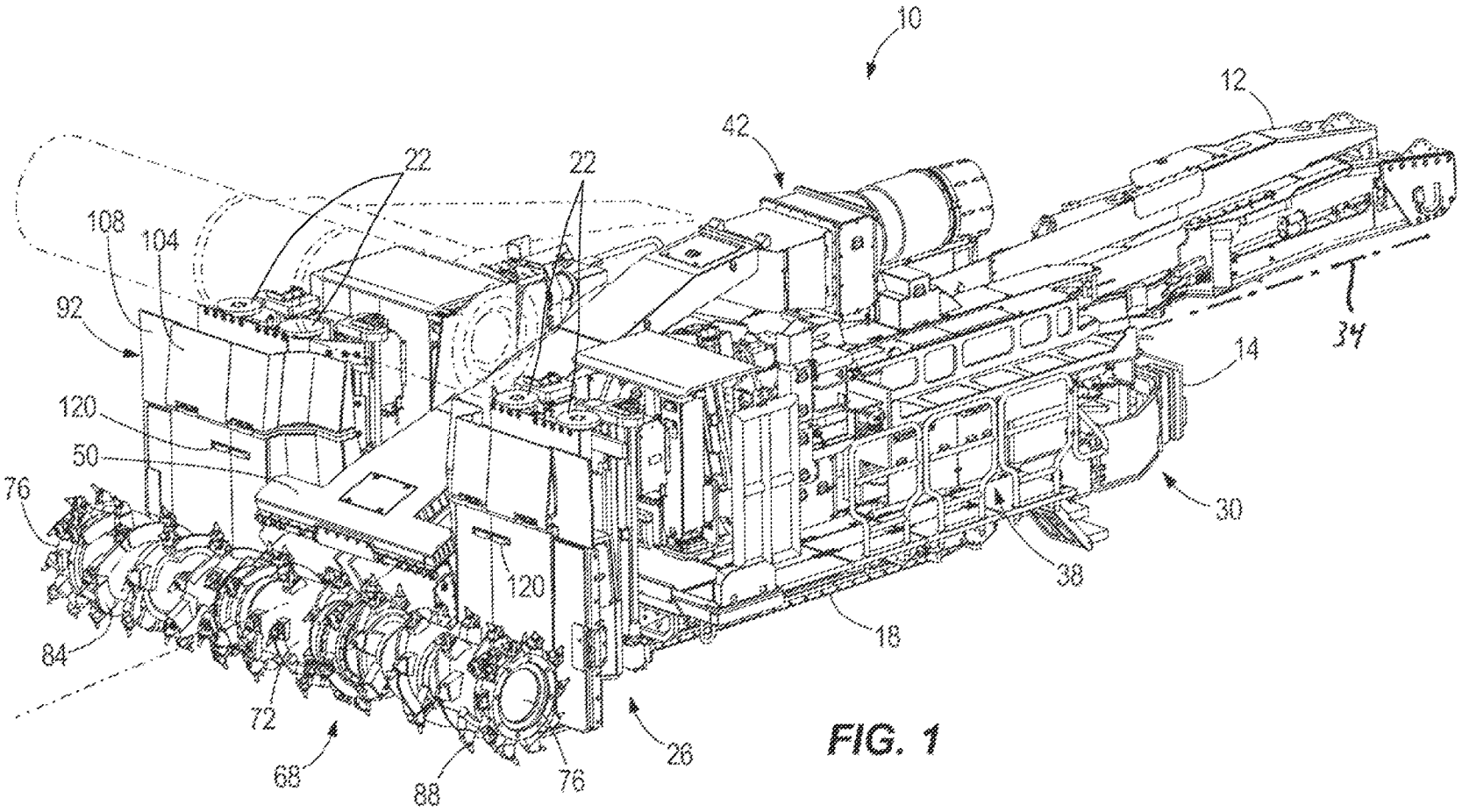
FIG. 1 is a perspective view of a mining machine with a sumping assembly in a retracted position and a cutting head in a lower position.

FIG. 1 shows an underground mining machine (e.g., a continuous miner) generally referred to as a mining machine 10. The illustrated embodiment of the mining machine 10, as shown in FIG. 1, is configured to perform a cutting operation that includes simultaneously cutting material from a mine face, and directing the cut material onto a conveyor 12 to transfer the cut material.

Figure 2:
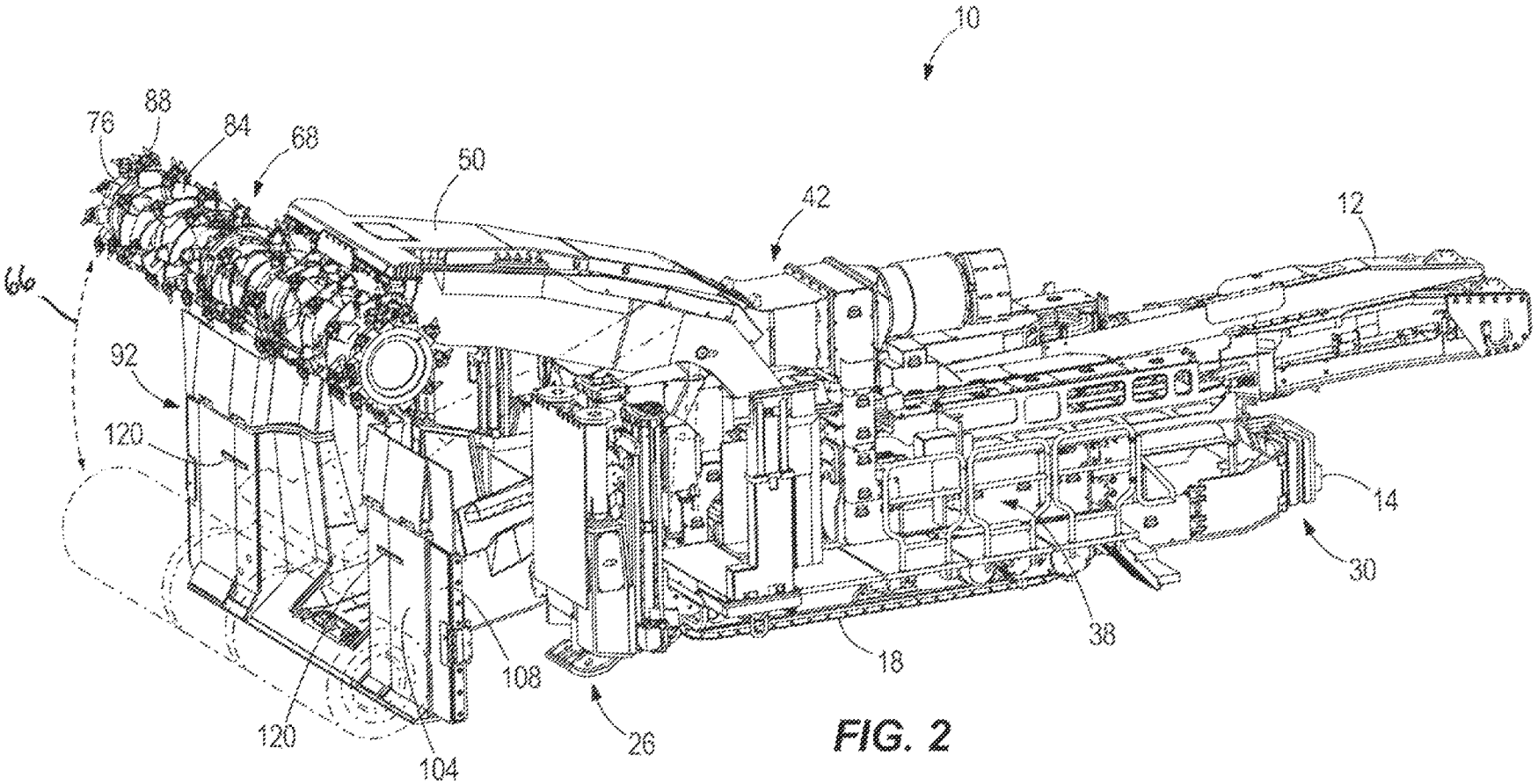
FIG. 2 is a perspective view of the mining machine of FIG. 1 with the sumping assembly in an extended position and the cutting head in an upper position.

Referring to FIGS. 1 and 2, the mining machine 10 includes a chassis 14 supported on a drive mechanism (e.g., tracks 18) to facilitate movement of the mining machine 10 and to position the machine 10 relative to a mine face (not shown) for performing the cutting operation. The chassis 14 includes a first or front end 26 and a second or rear end 30, and a chassis axis 34 extends between the front end 26 and the rear end 30 along the length of the machine 10. A conveyor 12 (FIG. 6) may extend between the front end 26 and the rear end 30 to move cut material toward the rear of the machine 10 and onto another conveyance mechanism (e.g., a conveyor or a haulage vehicle).

In one embodiment, the axis 34 may be oriented generally perpendicular to the mine face. In the illustrated embodiment, the tracks 18 of the chassis 14 are oriented in a direction parallel to the chassis axis 34. The machine 10 includes support mechanisms or anchors 22 for engaging a mine surface and providing additional stability for the chassis 14 once the chassis 14 is in a desired position. In some embodiments, additional support mechanisms such as roof bolts or cables may be inserted into the mine roof and/or rib to support the mine surfaces around the machine 10. The roof bolting equipment may be positioned on the machine 10 or on a separate machine (not shown). An operator station 38 is positioned between the front end 26 and the back end 30 and includes controls for operating the mining machine 10. In some embodiments, the mining machine 10 may be controlled remotely.

Figure 3:
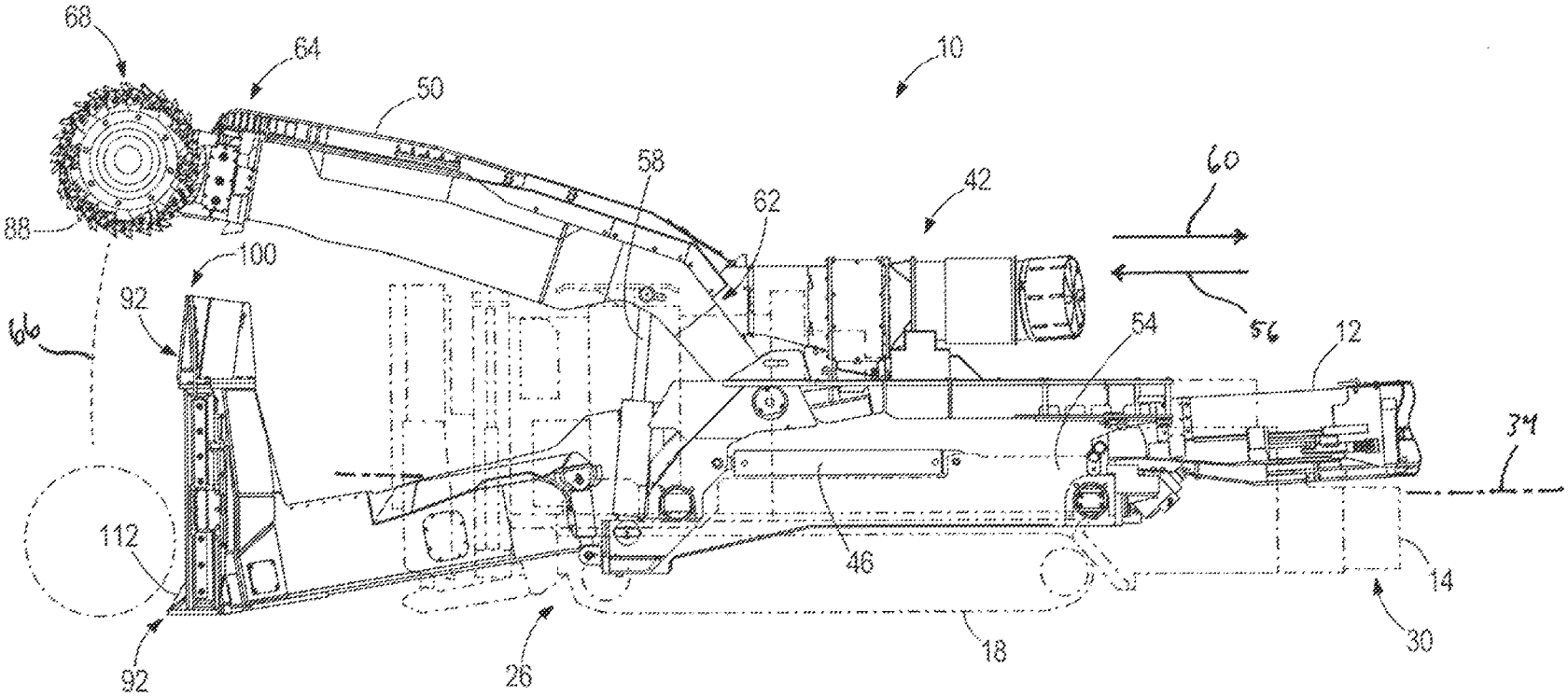
FIG. 3 is a side view of the mining machine with the sumping assembly in the extended position and the cutting head in the upper position.

As shown in FIG. 3, the mining machine 10 further includes a sumping assembly, which may include a boom 50 and a sumping frame 54. In the illustrated embodiment, the sumping frame 54 is movably coupled to the chassis 14, and the boom 50 is pivotably coupled to the sumping frame 54. The sumping frame 54 and is supported for translational movement parallel to the chassis axis 34 (e.g., toward the first end 26 or toward the rear end 30 of the chassis) in a first direction 56 and a second direction 60 opposite the first direction 56. The sumping frame 54 and boom 50 may move between a retracted position (FIG. 1) and an extended position (FIG. 2).

Referring to FIG. 3, in the illustrated embodiment, the sumping frame 54 and boom 50 are extended and refracted relative to the chassis 14 via a first actuator (e.g., first hydraulic cylinder 46) coupled between the sumping frame 54 and the chassis 14. The extension of the first cylinder 46 advances or sumps the sumping assembly toward the mine face to allow the cutting head 68 to cut material. In one embodiment, the chassis 14 may include one or more channels (not shown) extending parallel to the chassis axis 34, and the boom 50 may include a projection (e.g., a pin—not shown) positioned in each channel. The projections may slide along the channel as the boom 50 extends or retracts relative to the chassis 14. One example of such a system is described in U.S. Pat. No. 7,703,857, issued Apr. 27, 2010, the entire contents of which is incorporated by reference herein.

As shown in FIG. 3, the boom 50 includes a first end 62 and a second end 64, and the first end 62 is pivotably coupled to the sumping frame 54. The boom 50 may pivot in a vertical plane (e.g., along a path 66) between a mine roof and a mine floor to facilitate cutting material at various heights on a mine face. The boom 50 may pivot relative to the sumping frame 54 between a lower position, as shown in FIG. 1, and an upper position, as shown in FIG. 2. A second actuator (e.g., second hydraulic cylinder 58) is coupled between the boom 50 and the sumping frame 54 and moves the boom 50 between the lower and upper positions. The first and second hydraulic cylinders 46, 58 may be actuated separately, which may enable the boom 50 to pivot relative to the chassis 14 independently of the translational movement of the boom 50.

Figure 4:
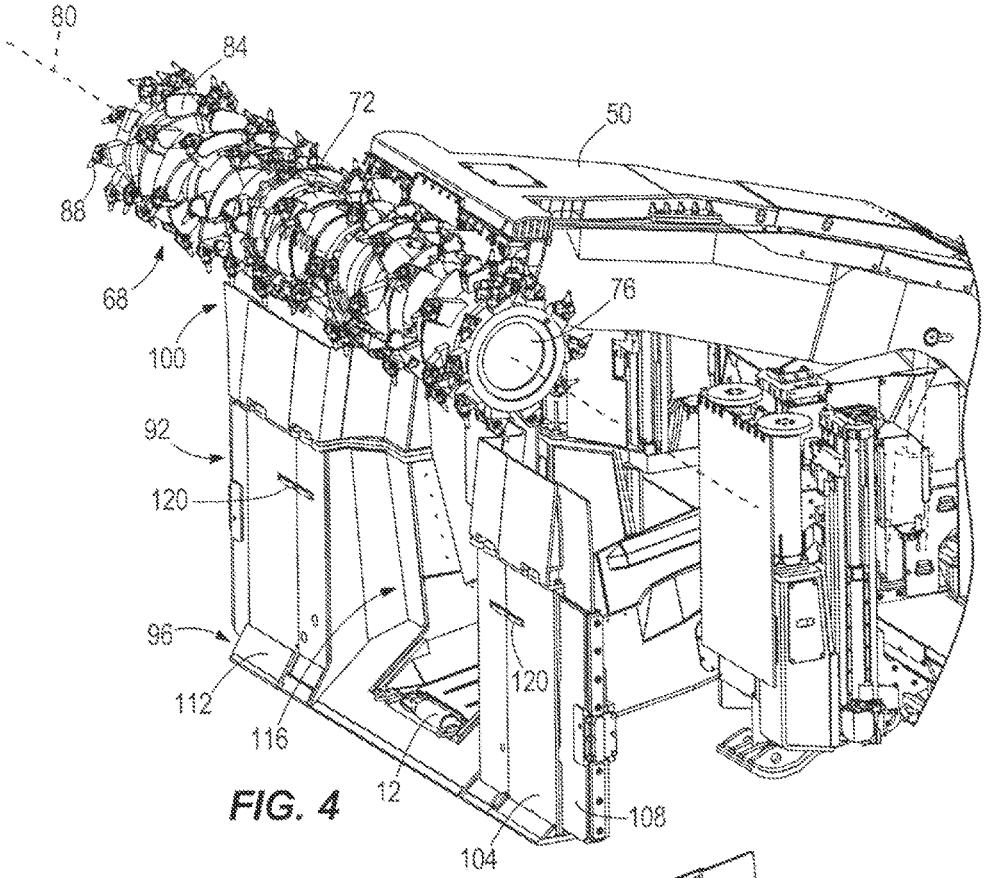
FIG. 4 is an enlarged perspective view of a cutter head and the sumping assembly.
Figure 5:
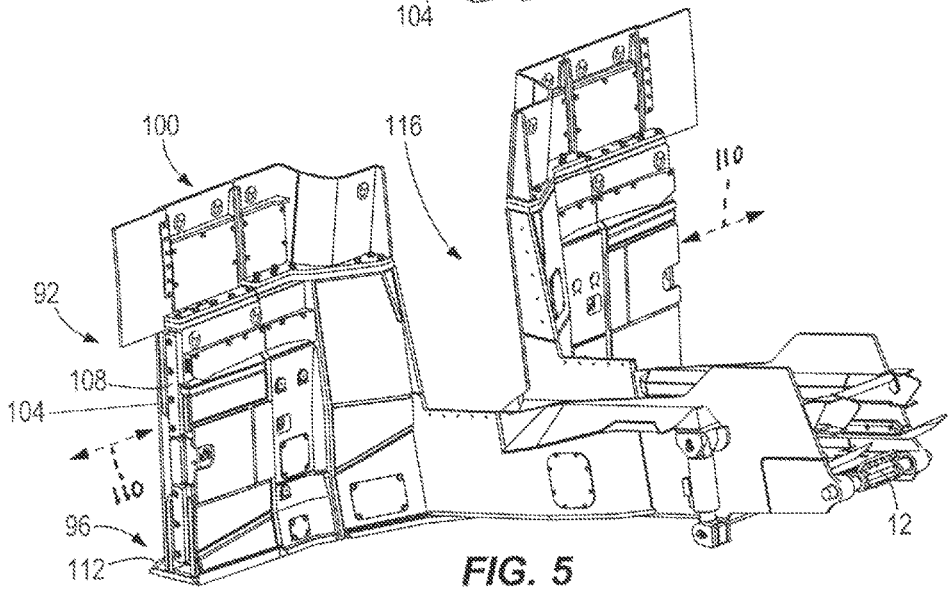
FIG. 5 is a rear perspective view of a portion of the sumping assembly.

As shown in FIGS. 3-5, a cutting head 68 is supported for rotation on the second end 64 of the boom 50. In the illustrated embodiment, the cutting head 68 includes end portions 76 and an intermediate portion 72 between the end portions 76. The cutting head 68 is generally formed as an elongated drum; in other embodiments, the cutting head may be formed in a different manner. For example, the cutting head may include structure to guide material toward the shield 92 and/or the conveyor 12. In one embodiment, the end portions 76 are movable relative to the intermediate portion 72 and can extend outwardly along the rotational axis 80 (i.e., along the paths 82) by a linear distance 86. Also, in one embodiment, a vane structure 84 extends around and along the surface of the cutting head 68 in a helical pattern. The vane structure 84 may be formed as two separate portions, each portion extending around the cutting head 68 from each end toward a center of the of the cutting head 68. Cutting bit assemblies 88 are secured to the cutting head 68 at intervals along the vane structure 84.

Referring now to FIGS. 4 and 5, the machine 10 (and particularly, the sumping assembly) further includes a shield 92 positioned between the cutting head 68 and the chassis 14. The shield 92 blocks the material cut from the mine face and entraps the material in an area between the shield 92 and the mine face. In the illustrated embodiment, the shield 92 is coupled to the sumping frame 54, and is therefore coupled to the boom 50. The shield 92 may be positioned proximate the cutting head 68. The shield 92 may be oriented in a substantially vertical plane and positioned substantially perpendicular to the chassis axis 34, and may be oriented substantially parallel to the mine face during operation. The shield 92 includes a lower end 96 proximate the mine floor and an upper end 100. The cutting head 68 is positioned adjacent the lower end 96 of the shield 92 in the lower position (FIG. 1), whereas the cutting head 68 is positioned adjacent the upper end 100 of the shield 92 in the upper position (FIG. 2).

The shield 92 includes a primary wall 104 and a secondary wall 108. Both the primary wall 104 and the secondary wall 108 are oriented in the plane of the shield 92. The secondary wall 108 is movably coupled to the primary wall 104. The secondary wall 108 may be actuated to extend outwardly relative to the primary wall 104 in a direction transverse to the chassis axis 34 (e.g., along the paths 110). Stated another way, the secondary wall 108 may move in a direction parallel to the rotational axis 80 of the cutting head 68. In the illustrated embodiment, the primary wall 104 includes lateral edges extending generally between the upper end 100 and the lower end 96, and the secondary wall 108 extends and retracts relative to the lateral edges of the primary wall 104 in a direction parallel to the plane of the shield 92. As shown in FIG. 5, the secondary wall 108 is disposed behind the primary wall 104, such that the secondary wall 108 is positioned between the primary wall 104 and the chassis 14.

Figure 6:
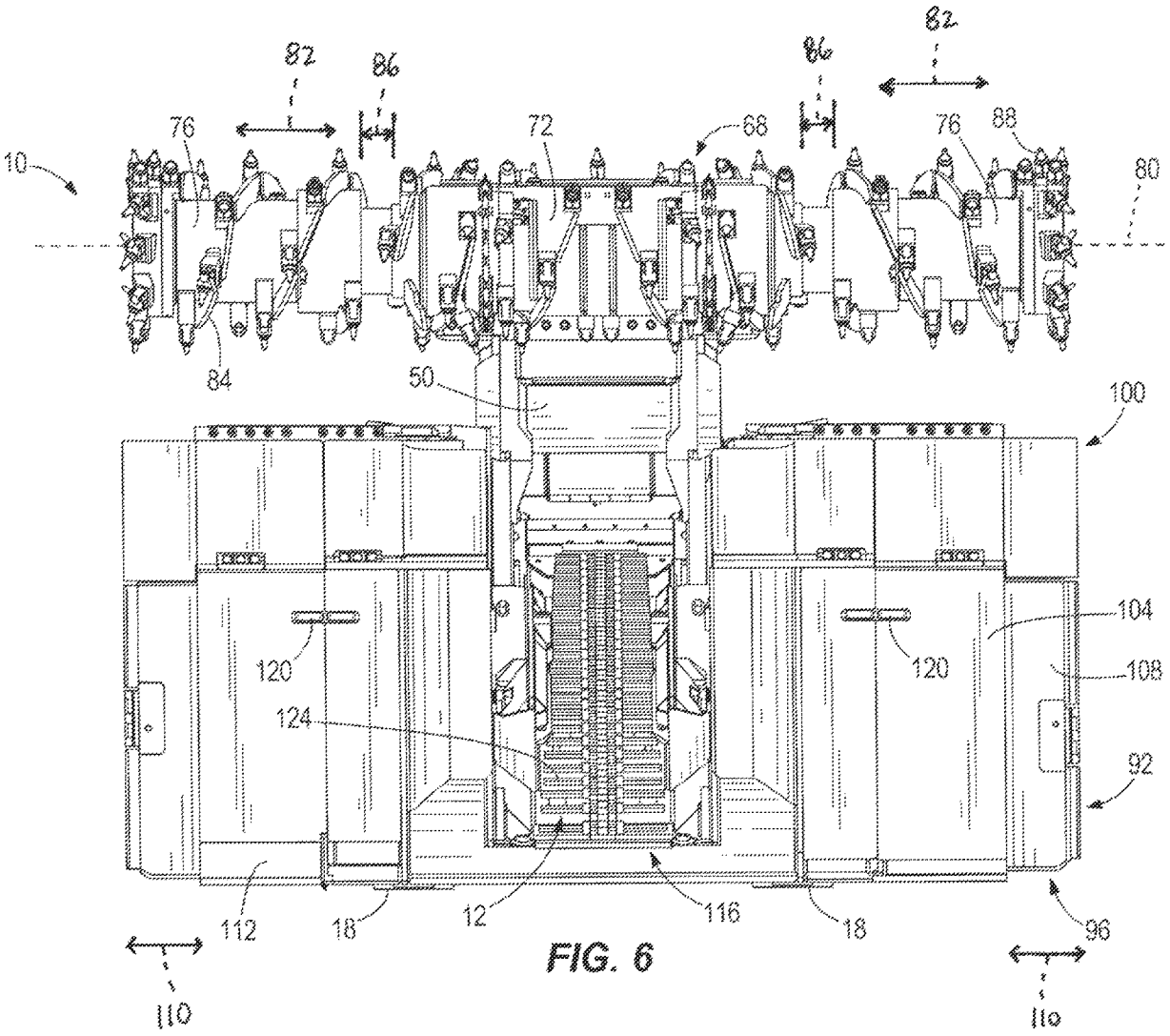
FIG. 6 is a front view of the mining machine of FIG. 1.

With reference to FIGS. 4-6, the shield 92 further includes a lip 112 proximate the lower end 96 of the shield 92. The lip 112 extends outwardly from the plane of the shield 92 and forms an acute angle relative to the primary wall 104. The lip 112 is configured to direct cut material away from the ground and onto the conveyor 12. In the illustrated embodiment, the primary wall 104 of the shield 92 is formed as two portions separated by a gap 116. The gap 116 is aligned with the conveyor 12, and the portions of the primary wall 104 adjacent the gap 116 are angled toward the chassis 14 to direct cut material through the gap 116 and onto the conveyor 12. In the illustrated embodiment, the shield 92 further includes a light 120 on each side of the gap 116 for illuminating the mine face. Although the illustrated embodiment of the shield 92 includes a pair of lights 120, in an alternative embodiment the shield 92 may include fewer or more lights 120 and the lights 120 may be arranged in a different manner.

As shown in FIG. 4, the conveyor 12 in the illustrated embodiment is coupled to the boom 50, and the conveyor 12 and boom 50 translate together relative to the chassis 34. Stated another way, the conveyor 12 and the boom 50 move generally parallel to the chassis axis 34, which may be perpendicular to the mine face. The conveyor 12 includes a plurality of flights 124 (FIG. 6) to move the cut material along a conveyor pan and toward the rear end 30.

An operator (either locally or remotely) moves the mining machine 10 into a desired position, aligning the chassis 14 in a desired orientation relative to the mine face. Once the machine 10 is positioned, the anchors 22 may be extended to engage a mine roof (not shown) and further secure the chassis 14 against movement. At this point, the boom 50 may be at any position between the lower position and the upper position. The sumping frame 54 is advanced or sumped toward the extended position via actuation of the first hydraulic cylinders 46 so that the cutting head 68 engages the mine face. Once the cutting head 68 engages with the mine face, the boom 50 may pivot vertically between the mine roof and the mine floor via actuation of the second hydraulic cylinders 58. More specifically, the boom 50 may pivot between the lower and upper positions. The cutting head 68 shear cuts the mine face such that the cutting bit assemblies 88 dislodge material (e.g., coal) from the face.

Frequently, the shear cutting operation causes the mined material to leave the mine face along various trajectories. Due to the location and geometry of the shield 92, the dislodged mined material is deflected off the shield 92 and directed toward the area forward of the shield 92. In other words, the shield 92 increases the amount of mined material entrained between the mine face and the shield 92.

As the sumping frame 54 is further advanced into the mine face, the cutting head 68 continues to cut or dislodge material. The cut material falls to the floor in front of the shield 92. The lip 112 of the shield 92 directs the cut material above the ground and toward the gap 116, where the material is deposited onto the conveyor 12. The cut material is subsequently transferred away from the front end 26 of the chassis 14. In the illustrated embodiment the cut material is transferred via the conveyor 12 toward the rear end 30 to be further processed or conveyed out of the mine.

The end portions 76 of the cutting head 68 and the secondary wall 108 can be actuated or extended outwardly in order to adjust the width of the mining profile and dislodge material. The secondary wall 108 and the end portions 76 can also be retracted as the mining operation progresses. In one embodiment, the secondary wall 108 moves (i.e., extends or retracts) relative to the primary wall 104 at a similar rate and distance as the end portions 76 move relative to the intermediate portion 72 of the cutting head 68 to correspondingly deflect the mined material. In other embodiments, the end portions 76 and the secondary wall 108 may move at different rates and distances.

When the sumping frame 54 is extended a maximum distance (i.e., when it reaches the extended position), the cutting operation may be paused and the sumping frame 54 subsequently may be moved to the retracted position. The anchors 22 may be disengaged and the mining machine 10 is advanced to be positioned closer to the new mine face. The previously described process may be repeated.

The sumping frame 54 and shield 92 may reduce the distance between the mine face and the support mechanisms (e.g., anchors or roof bolts), and may reduce overall machine weight. In particular, the sumping frame 54 and shield 92 weight may be reduced, and the total distance or range of travel of the sumping frame 54 and the boom 50 may increase without requiring a corresponding increase in the length of the chassis 14. Reducing the weight of the machine 10 also reduces the ground pressure. In addition, the compact design provides more room on the machine 10 for roof bolting equipment and storage space for the associated consumable products. Furthermore, in some embodiments the shield 92 and the cutting head 68 travel equal translational distances, thereby maintaining an efficient loading geometry.

Although the shield 92 has been described above with respect to a continuous mining machine 10, it is understood that a similar structure could be incorporated into another type of mining machine including an entry development machine and/or a roadheader.

The embodiment described above and illustrated in the figures are presented by way of example only and are not intended as a limitation upon the concepts and principles of the present application. Although the invention has been described in detail with reference to certain preferred embodiments, variations and modifications exist within the scope and spirit of one or more independent aspects of the invention as described. Various features and advantages are set forth in the following claims.

I claim:

1. A mining machine comprising:

a chassis including a first end and a second end, the chassis defining a chassis axis extending between the first end and the second end;

a boom including a first end and a second end, the boom supported for movement relative to the chassis, the boom translating in a first direction, the boom pivotable relative to the chassis between a first position and a second position;

a cutting head coupled to the second end of the boom and supported for rotation relative to the boom, the cutting head rotatable about a cutting head axis; and a shield supported for movement relative to the chassis and positioned proximate the cutting head, the shield including a lower end adjacent a mine floor and an upper end positioned above the chassis, the shield oriented in a vertical plane substantially perpendicular to the chassis axis, wherein the cutting head is positioned adjacent the lower end of the shield when the boom is in the first position and the cutting head is positioned adjacent the upper end of the shield when the boom is in the second position, wherein the shield includes a primary wall and a secondary wall moveable relative to the primary wall, and wherein the secondary wall extends and retracts relative to the primary wall in a translational manner in a direction transverse to the chassis axis.

2. The mining machine of claim 1, wherein the secondary wall includes a first portion and a second portion, the first portion positioned adjacent a first lateral edge of the primary wall, the second portion positioned adjacent a second lateral edge of the primary wall.

3. The mining machine of claim 1, wherein the shield further includes a lower end proximate a mine floor and an upper end, wherein the cutting head is positioned adjacent the lower end of the shield in the first position and the cutting head is positioned adjacent the upper end of the shield in the second position.

4. The mining machine of claim 1, wherein the shield and the boom are coupled to a sumping frame that is supported for translational movement relative to the chassis along the chassis axis.

5. The mining machine of claim 1, wherein the cutting head further includes a first portion and at least one end portion positioned proximate an end of the first portion, wherein the at least one end portion is movable relative to the first portion along the cutting head axis.

6. The mining machine of claim 1, wherein the pivoting movement of the boom is controlled independently of the translational movement of the boom.

7. The mining machine of claim 1, wherein the shield includes a first lateral portion and a second lateral portion, the first lateral portion and the second lateral portion spaced apart from one another by a gap.

8. The mining machine of claim 7, further comprising a conveyor supported for movement with the shield and aligned with the gap.

9. The mining machine of claim 7, wherein the shield includes a lip for directing cut material away from a mine floor, the shield adjacent the gap being angled to direct the cut material toward the gap.

10. A sumping assembly for a mining machine having a chassis defining a chassis axis, the chassis supported on a mine floor, the sumping assembly comprising:

a boom including a first end and a second end, the boom configured to be supported for movement relative to the chassis, the boom translating in a first direction and a second direction opposite the first direction;

a cutting head coupled to the second end of the boom and supported for rotation relative to the boom, the cutting head rotating about a cutting head axis; and a shield coupled to the boom and positioned proximate the cutting head, the shield oriented substantially perpendicular to the first direction, the shield including a first lateral portion, a second lateral portion, and a gap between the first lateral portion and the second lateral portion, the first lateral portion and the second lateral portion each include a lower end adjacent the mine floor and an upper end opposite the lower end, wherein the boom is movable through the gap, wherein the shield includes a primary wall and a secondary wall moveable relative to the primary wall, and wherein the secondary wall extends and retracts relative to the primary wall in a translational manner in a direction transverse to the chassis axis.

11. The sumping assembly of claim 10, further comprising a conveyor for moving cut material, the conveyor aligned with the gap.

12. The sumping assembly of claim 11, wherein the conveyor translates together with the shield in the first direction.

13. The sumping assembly of claim 11, wherein the shield includes a lip for directing cut material from the mine floor toward the conveyor.

14. The sumping assembly of claim 10, wherein the secondary wall includes a first portion and a second portion, the first portion positioned adjacent a first lateral edge of the primary wall, the second portion positioned adjacent a second lateral edge of the primary wall.

15. The sumping assembly of claim 10, wherein the cutting head includes an intermediate portion and at least one end portion coupled to an end of the intermediate portion, wherein the at least one end portion is movable relative to the intermediate portion along the cutting head axis.

16. The sumping assembly of claim 10, wherein the boom is pivotable in a third direction, the pivoting movement of the boom is controlled independently of the translational movement of the boom.

17. The sumping assembly of claim 10, wherein the shield and the boom are coupled to a sumping frame that is supported for translational movement relative to the chassis along the chassis axis.

18. A mining machine comprising:

a chassis including a first end and a second end, the chassis defining a chassis axis extending between the first end and the second end;

a sumping frame supported for movement relative to the chassis;

a boom including a first end and a second end, the first end pivotably coupled to the sumping frame;

a conveyor coupled to the sumping frame, the conveyor including flights travelling along a pan to move cut material toward the second end of the chassis;

a cutting head coupled to the second end of the boom and supported for rotation relative to the boom, the cutting head rotatable about a cutting head axis; and a shield coupled to the sumping frame and positioned proximate the cutting head, the shield including a lower end and an upper end, the shield oriented in a vertical plane substantially perpendicular to the chassis axis, wherein the cutting head is positioned adjacent the lower end of the shield when the boom is in the first position and the cutting head is positioned adjacent the upper end of the shield when the boom is in the second position, wherein the shield includes a primary wall and a secondary wall moveable relative to the primary wall, and wherein the secondary wall extends and retracts relative to the primary wall in a translational manner in a direction transverse to the chassis axis.

19. The mining machine of claim 18, wherein the cutting head further includes a first portion and at least one end portion movable relative to the first portion along the cutting head axis.

20. The mining machine of claim 18, wherein the shield includes a first lateral portion and a second lateral portion, the first lateral portion and the second lateral portion spaced apart from one another by a gap, wherein the conveyor is aligned with the gap.

21. The mining machine of claim 18, wherein the shield includes a lip for directing cut material from a mine floor toward the conveyor.

22. The mining machine of claim 18, wherein the conveyor includes a receiving end proximate the cutter head, wherein the shield is positioned between the cutter head and the receiving end of the conveyor with respect to the chassis axis.

* * * * *